US009461391B2

(12) United States Patent
Kato

(10) Patent No.: US 9,461,391 B2
(45) Date of Patent: Oct. 4, 2016

(54) CONNECTOR

(71) Applicant: ACES ELECTRONICS CO., LTD., Zhongli, Taoyuan County (TW)

(72) Inventor: Nobukazu Kato, Fussa (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 14/647,979

(22) PCT Filed: Nov. 28, 2013

(86) PCT No.: PCT/JP2013/081992
§ 371 (c)(1),
(2) Date: May 28, 2015

(87) PCT Pub. No.: WO2014/084293
PCT Pub. Date: Jun. 5, 2014

(65) Prior Publication Data

US 2015/0311619 A1 Oct. 29, 2015

(30) Foreign Application Priority Data

Nov. 30, 2012 (JP) ..... 2012-262271

(51) Int. Cl.
*H01R 13/6588* (2011.01)
*H01R 13/453* (2006.01)
(Continued)

(52) U.S. Cl.
CPC ..... *H01R 13/453* (2013.01); *H01R 12/714* (2013.01); *H01R 13/2428* (2013.01);
(Continued)

(58) Field of Classification Search
USPC ..... 439/137, 141, 138, 131, 139, 275, 113, 439/145
See application file for complete search history.

(56) References Cited

U.S. PATENT DOCUMENTS 1,394,057 A * 10/1921 Woernley ..... B61G 5/10 213/1.3
2,579,538 A * 12/1951 Bierce ..... H01R 13/453 174/67

(Continued)

FOREIGN PATENT DOCUMENTS

JP H04-106853 U 9/1992
JP H04-135176 U 12/1992

(Continued)

OTHER PUBLICATIONS

Machine-generated English translation of foreign reference JP 2006-173473, 17 pgs.

(Continued)

*Primary Examiner* — Alexander Gilman
(74) *Attorney, Agent, or Firm* — Chiesa Shahinian & Giantomasi PC

(57) ABSTRACT

A connector includes a contact including a contact point to be electrically connected to an external apparatus when a connecting terminal of the external apparatus is pressed against the contact point, a protection member for protecting the contact point, and a base body storing the contact and the protection member. The protection member includes an opening for projecting the contact point on the external apparatus side from a surface on which the external apparatus is pressed. The protection member is movable between a first position and a second position with movement of the external apparatus. At the first position, the contact point is arranged so as to project on the external apparatus side from the opening. At the second position, the contact point is arranged on the same plane as the surface of the protection member on which the external apparatus is pressed.

15 Claims, 22 Drawing Sheets

(51) Int. Cl.
*H01R 13/6594* (2011.01)
*H01R 12/71* (2011.01)
*H01R 13/24* (2006.01)
*H01R 13/62* (2006.01)

(52) U.S. Cl.
CPC ..... *H01R13/6588* (2013.01); *H01R 13/6594* (2013.01); *H01R 13/4538* (2013.01); *H01R 13/6205* (2013.01)

(56) References Cited

U.S. PATENT DOCUMENTS 3,271,725 A * 9/1966 Bloch ..... H01R 13/453 439/141
3,736,547 A * 5/1973 Koenig ..... H01R 13/453 439/137
3,853,376 A * 12/1974 Marechal ..... H01R 13/645 439/139
3,909,566 A * 9/1975 Morrison ..... H01R 13/453 200/51.07
4,544,219 A * 10/1985 Barkas ..... H01R 13/4534 439/137
5,144,217 A * 9/1992 Gardner ..... H01M 2/1055 320/110
5,823,832 A * 10/1998 Das ..... A61B 5/0416 439/817
6,048,228 A * 4/2000 Aso ..... H01R 13/2428 439/660
6,159,055 A * 12/2000 Satitpunwaycha . H01L 21/6833 439/700
6,494,748 B1 * 12/2002 Mori ..... H01R 13/2421 439/700
6,875,031 B1 * 4/2005 Korsunsky ..... H01R 23/6873 439/607.05
8,461,024 B2 * 6/2013 Johnson ..... G01R 31/2889 438/17
8,784,145 B2 * 7/2014 Koyama ..... H01R 13/2464 439/500
2012/0282786 A1 * 11/2012 Neel ..... H01R 11/30 439/39
2013/0143425 A1 * 6/2013 Smrke ..... H01R 13/453 439/136
2014/0162468 A1 * 6/2014 Kim ..... H01R 13/6205 439/39
2015/0311619 A1 * 10/2015 Kato ..... H01R 13/6594 439/137

FOREIGN PATENT DOCUMENTS

JP H08-250190 A 9/1996
JP 11-74014 A 3/1999
JP 2002-151219 A 5/2002
JP 2005-174904 A 6/2005
JP 2006-173473 A 6/2006
JP 2007-324029 A 12/2007

OTHER PUBLICATIONS

Machine-generated English translation of foreign reference JP 2002-151219, 7 pgs.
Machine-generated English translation of foreign reference JP H08-250190, 8 pgs.
Machine-generated English translation of foreign reference JP 2007-324029, 9 pgs.
International Preliminary Report on Patentability issued Jun. 2, 2015, in connection with International Patent Application No. PCT/JP2013/081992, 19 pgs.
International Search Report mailed Mar. 4, 2014, in connection with International Patent Application No. PCT/JP2013/081992, 6 pgs.

* cited by examiner

CONNECTOR

TECHNICAL FIELD

The present invention relates to a connector connected to a connecting terminal of an electronic device.

BACKGROUND ART

A cradle for a personal digital assistant including a connector having a spring-like terminal is conventionally known (for example, refer to Patent Literature 1). According to the cradle for a personal digital assistant, the portable digital assistance and the connector are electrically connected when a connecting terminal of the personal digital assistant is pressed against the spring-like terminal in the case where the personal digital assistant is mounted to the cradle.

Also, a pogo pin connector including multiple mobile pins (pogo pins), which expand or contract by a spring, and a USB connector, in which a USB terminal is directly inserted to a connector, are known.

CITATION LIST

Patent Literature

Patent Literature 1: JP 2006-173473 A

SUMMARY OF INVENTION

Technical Problem

However, in the above-described cradle for a personal digital assistant, since a spring-like terminal widely projects from a surface of the connector, the terminal might be deformed when a finger or a pen comes into contact with the terminal.

Also, there are issues that manufacturing cost of a pogo pin connector is high, and a USB connector is easily damaged during mounting and dismounting of a USB terminal.

An object of the present invention is to provide a connector which is inexpensive and unlikely to break down.

Solution to Problem

A connector according to the present invention includes a contact including a contact point to be electrically connected to an external apparatus when a connecting terminal of the external apparatus is pressed against the contact point, a protection member for protecting the contact point by covering a periphery of the contact point of the contact, and a base body made of an insulator and storing the connect and the protection member. The protection member includes an opening for projecting the contact point on the external apparatus side from a surface on which the external apparatus is pressed. The protection member is movable between a first position and a second position with movement of the external apparatus. At the first position, the contact point is arranged so as to project on the external apparatus side from the opening. At the second position, the contact point is arranged on the same plane as the surface of the protection member on which the external apparatus is pressed.

Advantageous Effects of Invention

According to the present invention, a connector, which is inexpensive and unlikely to break down, can be provided.

DESCRIPTION OF EMBODIMENTS

Figure 1:
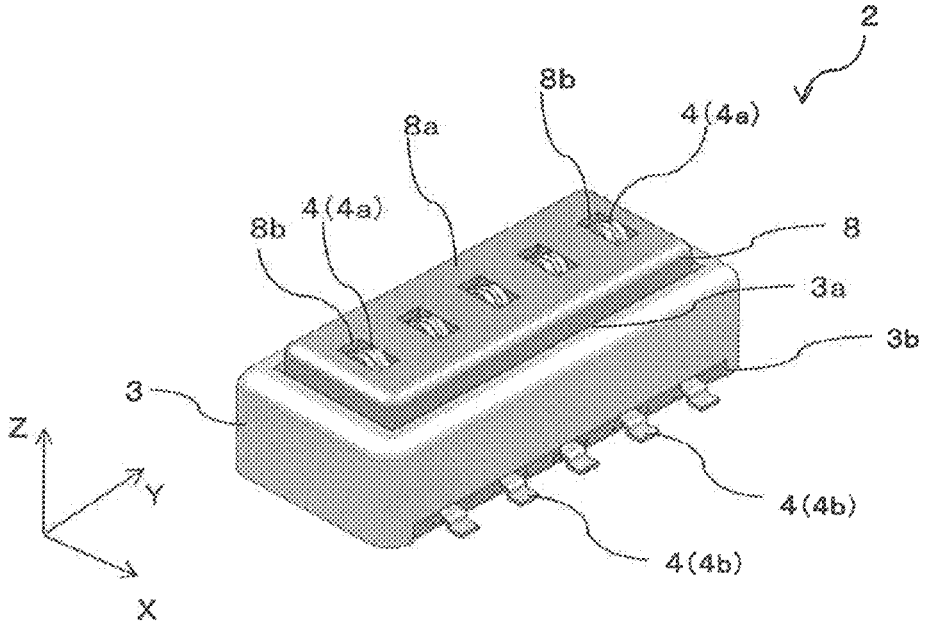
FIG. 1 is a perspective view illustrating an appearance of a connector according to a first embodiment.
Figure 2:
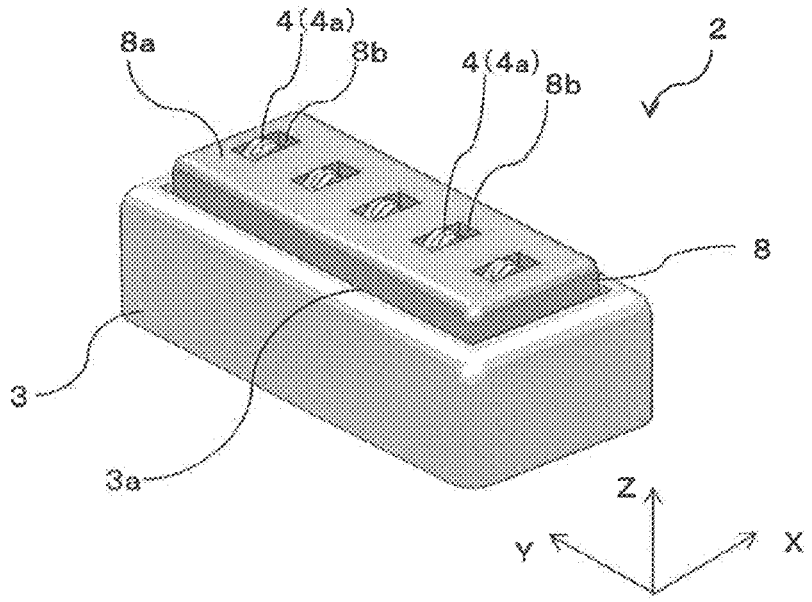
FIG. 2 is a perspective view illustrating an appearance of the connector according to the first embodiment.
Figure 3:
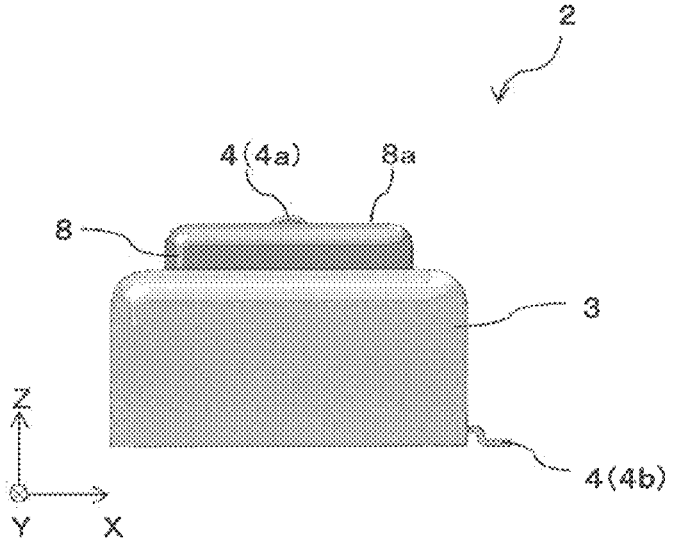
FIG. 3 is a side view illustrating an appearance of the connector according to the first embodiment.

Hereinafter, a connector according to a first embodiment will be described with reference to drawings by taking a press type connector electrically connected to a personal digital assistant when a connecting terminal of the personal digital assistant is pressed as an example. FIGS. 1 and 2 are perspective views illustrating an appearance of the connector according to the first embodiment. FIG. 3 is a side view of the connector. An XYZ orthogonal coordinate system will be set in a description below, and the XYZ orthogonal coordinate system is referred in the description. As illustrated in FIG. 1, the XYZ orthogonal coordinate system is set on a surface on which an XY plane is parallel to a bottom surface of a connector 2, and a Z axis is set in a vertical direction of the XY plane.

As illustrated in FIGS. 1 to 3, the connector 2 includes a rectangular parallelepiped base body 3 including an insulating member having an insulation property. A rectangular first opening 3*a* is formed on an upper surface (+Z direction side) of the base body 3. Also, in the first opening 3*a*, by covering multiple metal contacts 4 arranged in the base body 3 from an upper side, a protection member 8 for protecting contact points 4*a* of the contacts 4 is arranged so as to project from an upper surface of the base body 3.

On an upper surface 8*a* of the protection member 8, multiple rectangular openings 8*b* are formed along a Y axis direction for exposing the contact point 4*a* of each of the multiple contacts 4 from the protection member 8. The contact point 4*a* has a chevron shape and comes into contact with a connecting terminal 20*a* of a personal digital assistant 20 (see FIG. 6) in the case where the personal digital assistant 20 (see FIG. 6) is pressed downward.

Also, a slit-like second opening 3*b* for exposing a lower side end 4*b* of the contact 4 is formed at a lower portion of a +X direction side surface of the base body 3. The end 4*b* exposing from the second opening 3*b* is connected to a power supply control unit of an electronic device in which the connector 2 is mounted.

Figure 4:
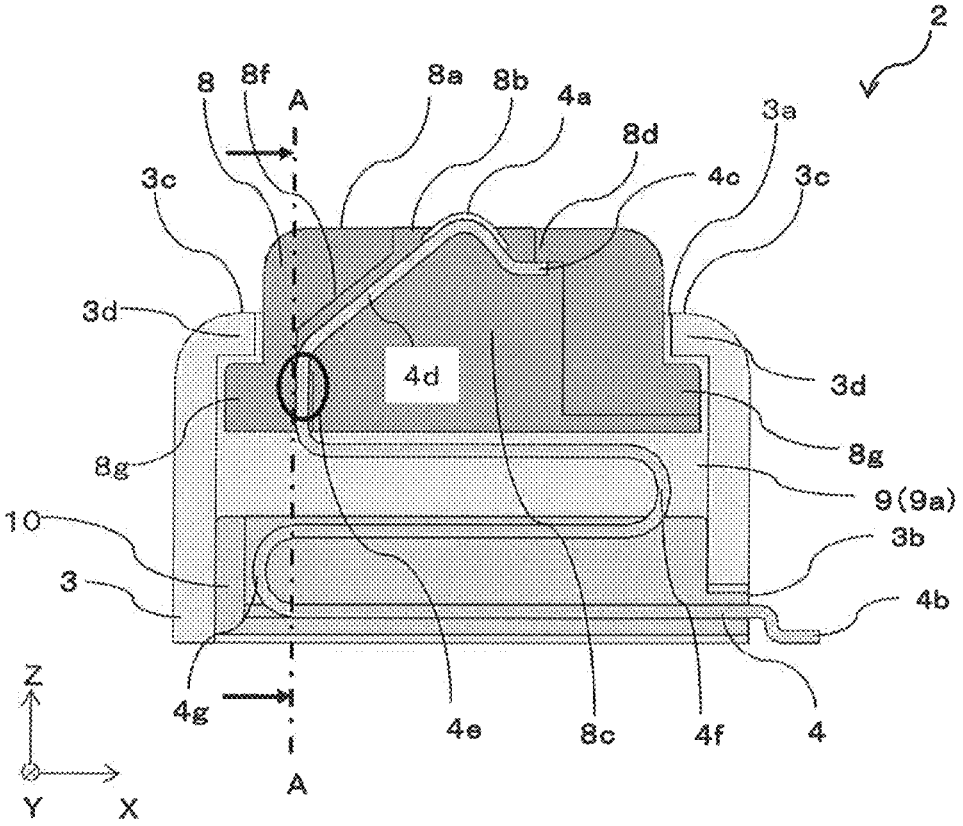
FIG. 4 is a cross-sectional view of the connector according to the first embodiment.
Figure 5:
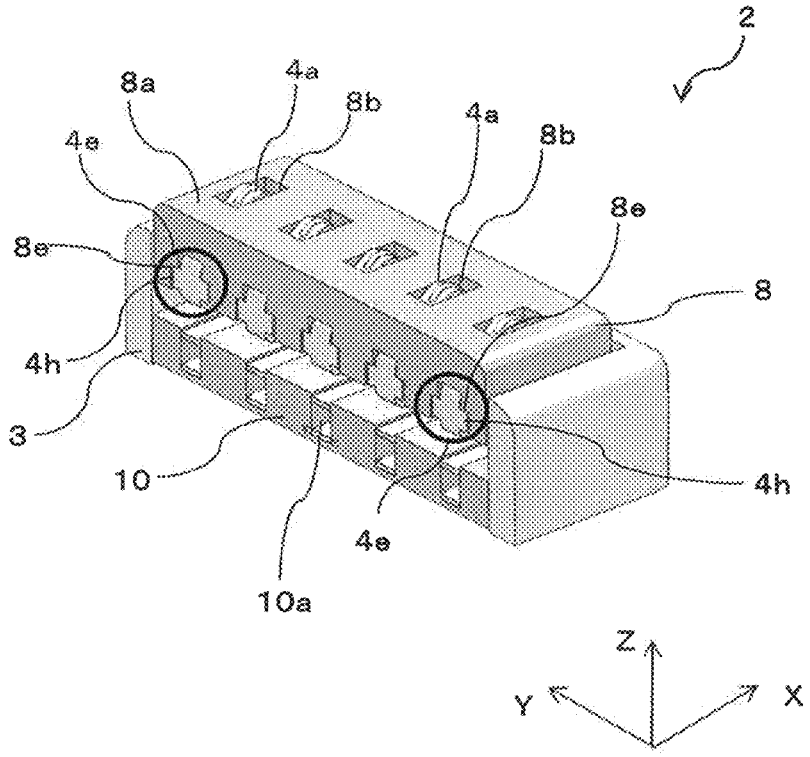
FIG. 5 is a cross-sectional view of the connector according to the first embodiment.

FIG. 4 is a view of an XZ cross-sectional surface of the connector 2 according to the first embodiment when viewed from a −Y direction side. FIG. 5 is a cutaway view of the connector 2 on an A-A cross-sectional surface illustrated in FIG. 4. As illustrated in FIG. 4, a rectangular parallelepiped hollow 9 is formed in the base body 3. Herein, the protection member 8 is arranged on an upper side of the hollow 9, and a fixing member 10 for fixing the contact 4 at a predetermined position is arranged on a lower side of the hollow 9. Also, a moving space 9*a* for moving the protection member 8 downward is provided between the protection member 8 and the fixing member 10.

The contact 4 has an approximately S shape, and the contact point 4*a* arranged at an upper end of the approximately S shape projects from the opening 8*b* of the protection member 8. The lower side end 4*b* which is one end of the contact 4 is exposed from the second opening 3*b*. The contact 4 includes, at another end on an upper side thereof, a press portion 4*c* for pressing the protection member 8 upward and includes an inclined portion 4*d* inclining downward, a first folded portion 4*e*, a second folded portion 4*f*, and a third folded portion 4*g* in this order from the contact point 4*a* toward the lower side end 4*b*. Also, as illustrated in FIG. 5, an overhang portion 4*h* overhanging in a ±Y direction of the contact 4 is formed to the first folded portion 4*e*.

A trapezoidal space 8*c* is formed in the inside of the protection member 8. The space 8*c* includes a first engaging portion 8*d*, a second engaging portion 8*e*, and an inclined portion 8*f*. In the case where the contact 4 is covered by the protection member 8, the first engaging portion 8*d* is engaged with the press portion 4*c* of the contact 4, the second engaging portion 8*e* is engaged with the overhang portion 4*h* of the contact 4, and the inclined portion 8*f* is arranged at a position corresponding to the inclined portion 4*d* of the contact 4. Therefore, when the contact is covered by the protection member 8, the protection member 8 is supported by the first engaging portion 8*d* and the second engaging portion 8*e*, and the state is maintained in which the protection member 8 projects from an upper side of the base body 3.

An outward projecting portion 8*g* projecting outward of the protection member 8 is formed on a lower side of the protection member 8. An inward projecting portion 3*d* projecting inward of the base body 3 is formed on an upper side of the base body 3. Therefore, when the protection member 8 moves in a +Z direction, the outward projecting portion 8*g* is locked by the inward projecting portion 3*d* to prevent from removing the protection member 8 from the base body 3.

Multiple rectangular grooves 10*a* are formed to the fixing member 10 along a Y axis direction. A lower portion of the contact 4 including the third folded portion 4*g* is arranged in the groove 10*a*. As a result, the contact 4 is accurately fixed at a predetermined position in the connector 2.

The second folded portion 4*f* of the contact 4 is arranged in the moving space 9*a*. In the case where the protection member 8 moves downward, the second folded portion 4*f* moves to the inside of the groove 10*a* of the fixing member 10 when the contact 4 is compressed in a Z axis direction (see FIGS. 7 and 8).

Next, displacement of the protection member 8 and the contact point 4*a* in a process of mounting a personal digital assistant to the connector 2 according to the first embodiment will be described with reference to FIGS. 6 to 8 by taking as an example a case where the personal digital assistant is charged. First, an operator prepares the connector 2 and the personal digital assistant 20 to be charged.

Figure 6:
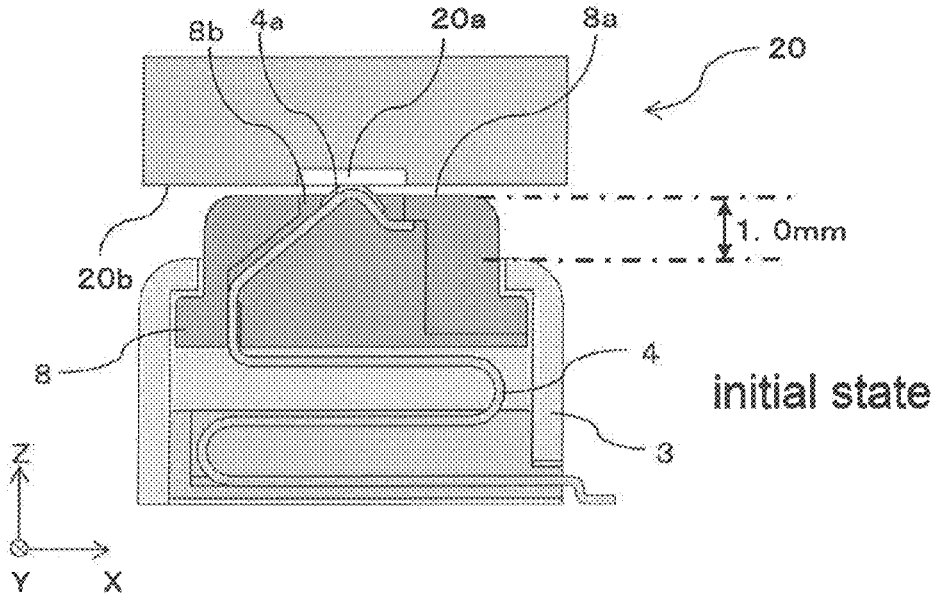
FIG. 6 is a view illustrating displacement of a protection member and a contact point in the case where the connector according to the first embodiment is used.

As illustrated in FIG. 6, the connector 2 is maintained in a state in which the upper surface 8*a* of the protection member 8 projects 1.0 mm from an upper surface 3*c* of the base body 3 (hereinafter called an initial state). Also, in the initial state, the protection member 8 is arranged at a first position in which the upper surface 8*a* projects from the upper surface 3*c* of the base body 3 and the contact point 4*a* projects by a predetermined amount from the upper surface 8*a*. A projection amount of the contact point 4*a* at the first position is a minimum projection amount necessary for bringing the connecting terminal 20*a* into contact with the contact point 4*a* when the personal digital assistant 20 is mounted to the connector 2.

Figure 7:
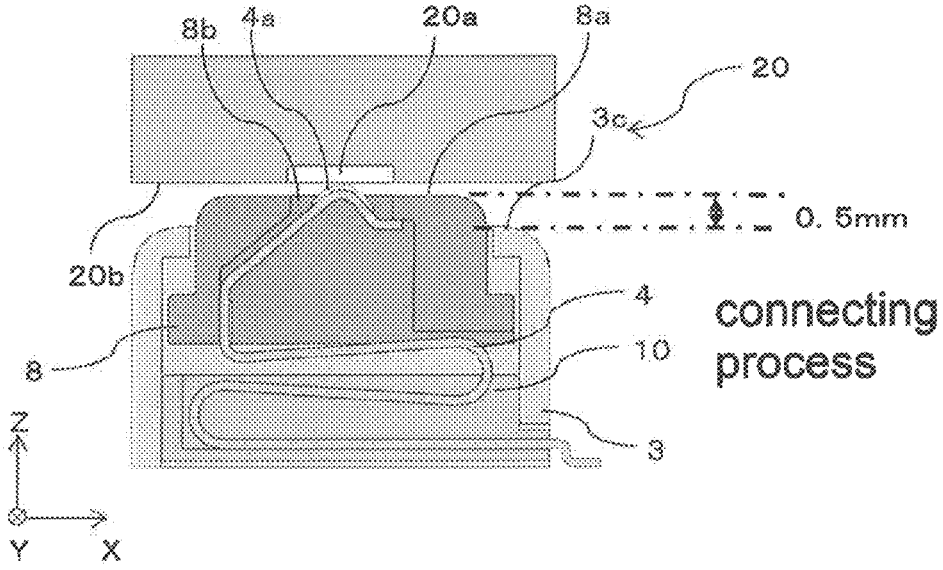
FIG. 7 is a view illustrating displacement of the protection member and the contact point in the case where the connector according to the first embodiment is used.

When the connecting terminal 20*a* of the personal digital assistant 20 is pressed against the contact point 4*a* of the connector 2 in the initial state, and a downward (−Z direction side) pressing force is applied to the contact point 4*a*, the contact point 4*a* moves downward and the contact 4 is compressed in a Z axis direction as illustrated in FIG. 7. Accordingly, the protection member 8 covering the contact 4 moves downward (a connecting process).

FIG. 7 illustrates a state in which the contact point 4*a* and the protection member 8 have moved 0.5 mm below the initial state position. Also, in the connecting process, a positional relation between the contact point 4*a* and the protection member 8 does not change, and the contact point 4*a* is continuously disposed at a position where the contact point 4*a* projects by a predetermined amount from the upper surface 8*a*.

When the contact point 4*a* and the protection member 8 move 0.5 mm downward (specifically, 1.0 mm below the initial state position), the protection member 8 stops moving by coming into contact with the fixing member 10, and the upper surface 8*a* of the protection member 8 moves to the same plane as the upper surface 3*c* of the base body 3.

Figure 8:
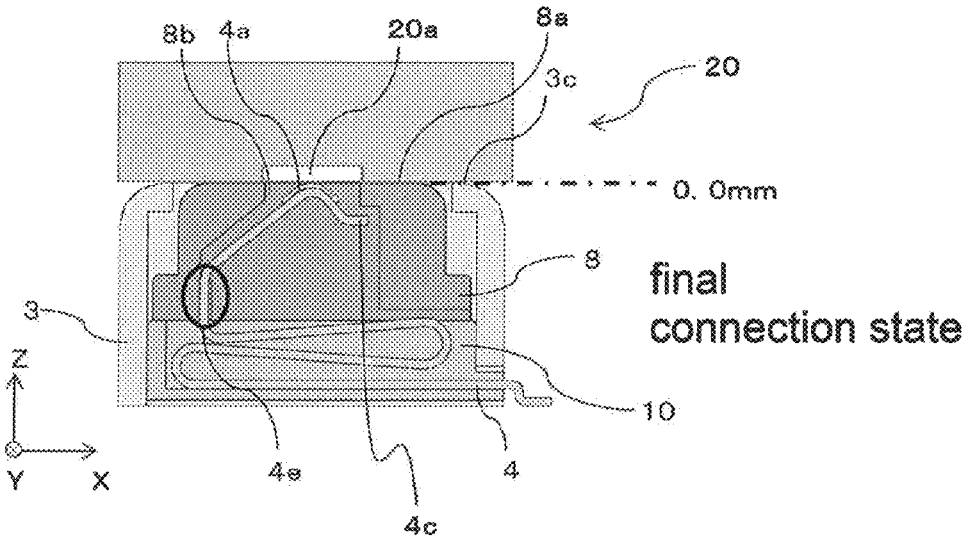
FIG. 8 is a view illustrating displacement of the protection member and the contact point in the case where the connector according to the first embodiment is used.

The contact point 4*a* further moves downward, as illustrated in FIG. 8, the press portion 4*c* of the contact 4 is removed from the first engaging portion 8*d*, and also the overhang portion 4*h* is removed from the second engaging portion 8*e* (see FIG. 5). Herein, the upper surface 8*a* of the protection member 8 is arranged on the same plane as the upper surface 3*c* of the base body 3, and the contact point 4*a* is arranged at the second position on the same plane as the upper surface 8*a* (a final connection state). In the final connection state, the contact point 4*a* is always biased upward by a spring force of the compressed contact 4, and the contact point 4*a* comes into contact with the connecting terminal 20*a* by a sufficient contact force. Therefore, the personal digital assistant 20 can be certainly charged via the connector 2.

According to the connector 2 according to the first embodiment, the contact point 4*a* is protected by covering with the protection member 8 having a simple structure around the contact point 4*a*. Therefore, a connector, which is inexpensive and unlikely to break down, can be provided. For example, since the contact point 4*a* is protected by the protection member 8, deformation of the contact 4 by contact with a finger or a pen tip can be prevented even if a finger or a pen tip accidentally touches to the connector 2 in the initial state and the connecting process.

In the final connection state, the contact point 4*a* is moved from the first position to the second position, the contact point 4*a* can come into contact with the connecting terminal 20*a* by a sufficient pressing force. Also, since the protection member 8 covers a periphery of the contact point 4*a*, an upper portion of the contact 4 is not widely exposed from the connector 2, and therefore the connector 2 can have a good appearance.

Although a case where one contact 4 includes one contact point 4*a* has been described in the above-described first embodiment, one contact may include multiple contact points. For example, two contact points may project from the opening 8*b*. In the case where the contact 4 is covered by the protection member 8, an engaging portion to be engaged with a valley portion formed between two contact points of the contact 4 may be formed to the space 8*c*.

Next, a connector according to a second embodiment will be described. The connector according to the second embodiment is a connector according to the first embodiment in which a protection member is further covered with a shield member and also a magnetic body is arranged in a base body. Therefore, a point different form the first embodiment will be described in detail in the second embodiment, and an overlapped description will be appropriately omitted. In the description of the second embodiment, the same configuration as the configuration of the connector according to the first embodiment will be described by using the signs used in the description of the first embodiment.

Figure 9:
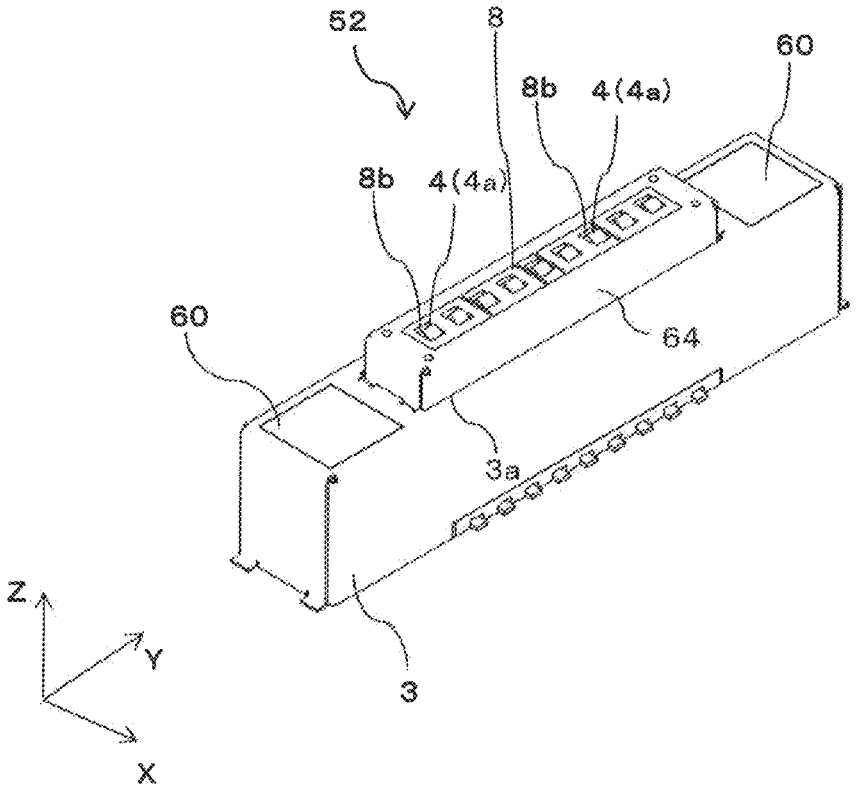
FIG. 9 is a perspective view illustrating an appearance of a connector according to a second embodiment.
Figure 10:
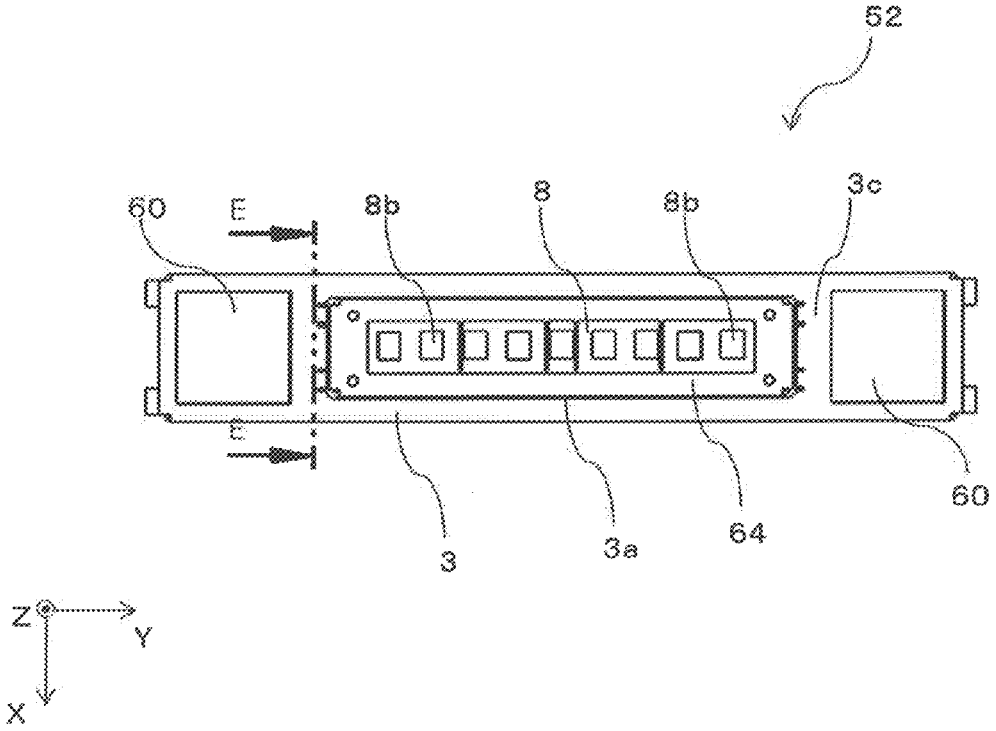
FIG. 10 is a top view of the connector according to the second embodiment.

FIG. 9 is a perspective view illustrating an appearance of the connector according to the second embodiment. FIG. 10 is a top view of the connector. As illustrated in FIGS. 9 and 10, a connector 52 includes a rectangular parallelepiped base body 3 having an insulation property. A first opening 3*a* is formed on an upper surface of the base body 3, and an upper surface of a magnet 60 stored in the base body 3 is exposed from both ends of the base body 3 sandwiching the first opening 3*a*. Also, in the first opening 3*a*, the protection member 8 for protecting a contact point 4*a* of a contact 4 is arranged so as to project from the upper surface of the base body 3. The protection member 8 is covered by a shield member 64 formed by pressing a metal plate.

Figure 11:
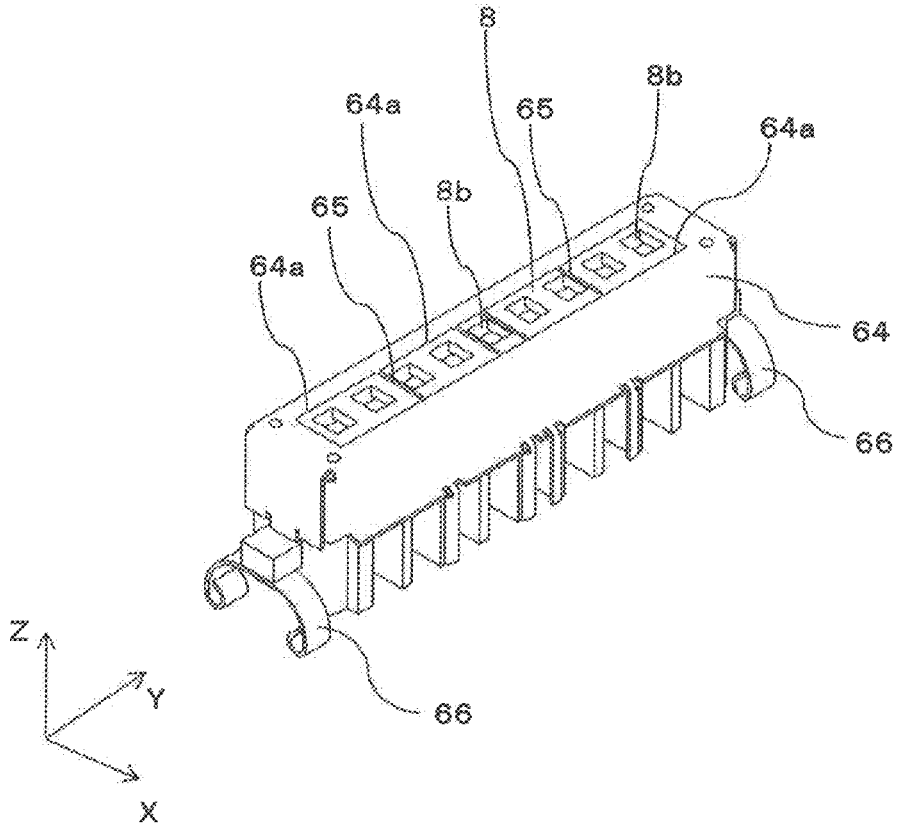
FIG. 11 is a perspective view illustrating a state in which a protection member according to the second embodiment is covered by a shield member.
Figure 12:
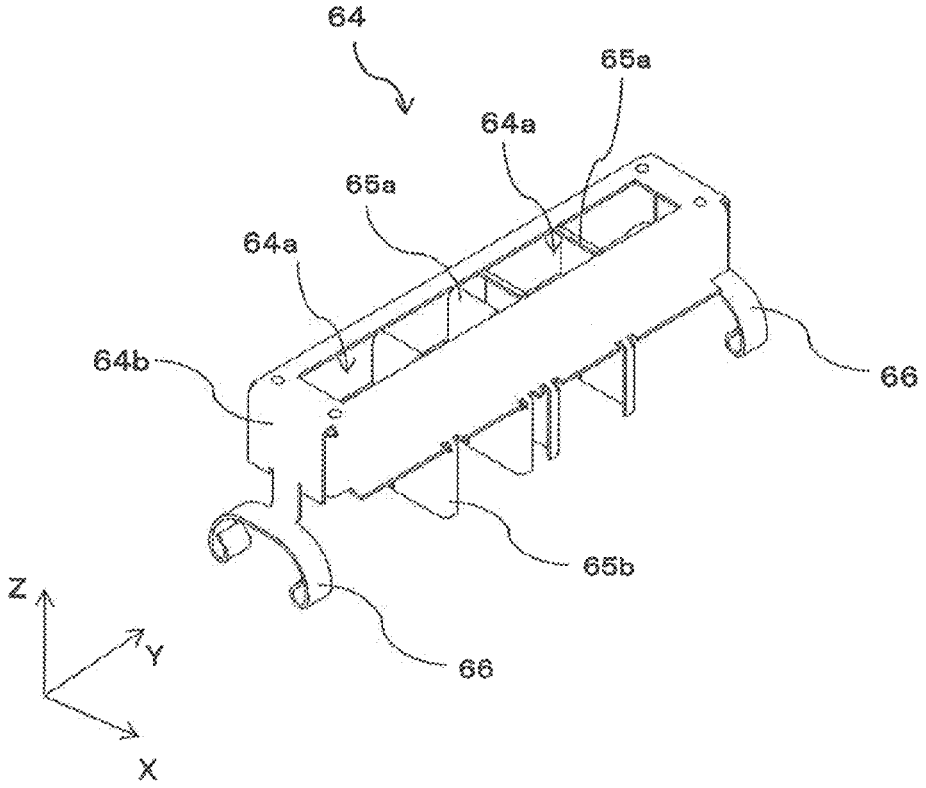
FIG. 12 is a perspective view illustrating an appearance of the shield member according to the second embodiment.
Figure 13:
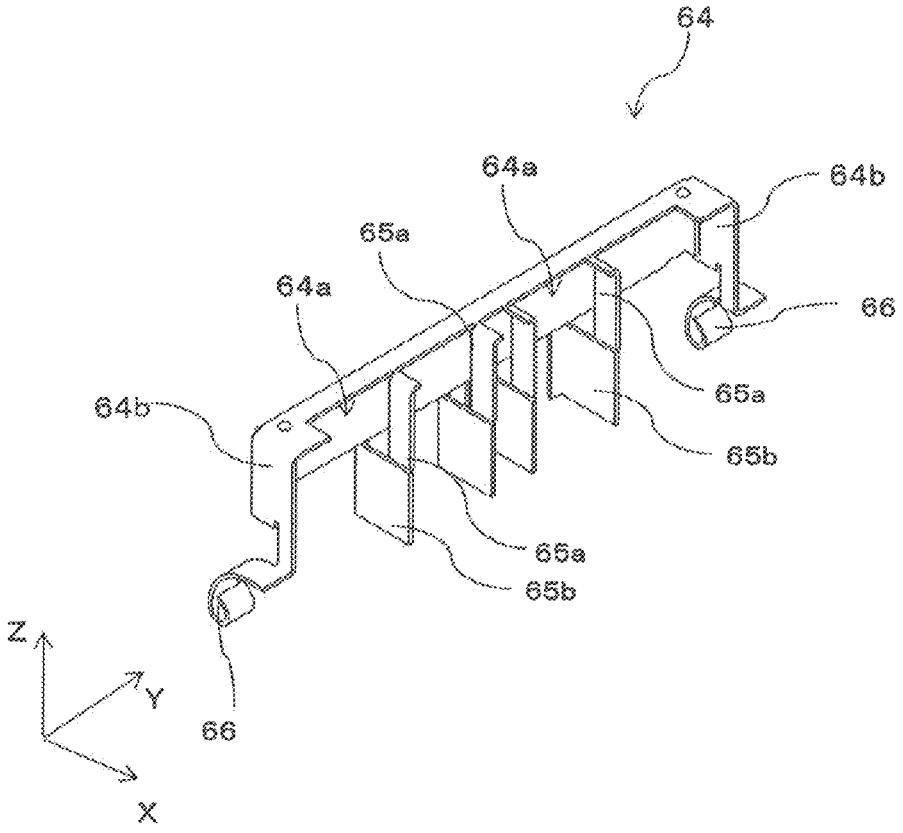
FIG. 13 is a cutaway view of the shield member according to the second embodiment.

FIG. 11 is a perspective view illustrating a state in which the protection member 8 according to the second embodiment is covered by the shield member 64. FIG. 12 is a perspective view illustrating an appearance of the shield member 64 according to the second embodiment. FIG. 13 is a view illustrating a state in which the shield member 64 is cut in a Y axis direction. As illustrated in FIG. 11, an upper surface of the protection member 8, both side wall surfaces extending in a lateral direction (X axis direction), and both side wall surfaces extending in a longitudinal direction (Y axis direction) are covered by the shield member 64. Multiple rectangular openings 64*a* are formed on an upper surface of the shield member 64, and a predetermined area including the opening 8*b* of the protection member 8 is exposed from the shield member 64.

Also, the shield member 64 includes multiple metal plates 65 interposed between the openings 8*b* in which the adjacent contacts 4 are arranged. Herein, the metal plate 65 includes a first metal plate 65*a* and a second metal plate 65*b*. The first metal plate 65*a* is approximately vertically bent downward (a −Z direction) from an upper surface of the protection member 8. The second metal plate 65*b* is approximately vertically bent toward a Y axis direction in a lower portion of a side wall surface of the shield member 64. Also, a U-shaped elastic body 66 is formed at a lower portion of a side wall surface 64*b* of the shield member 64.

Figure 14:
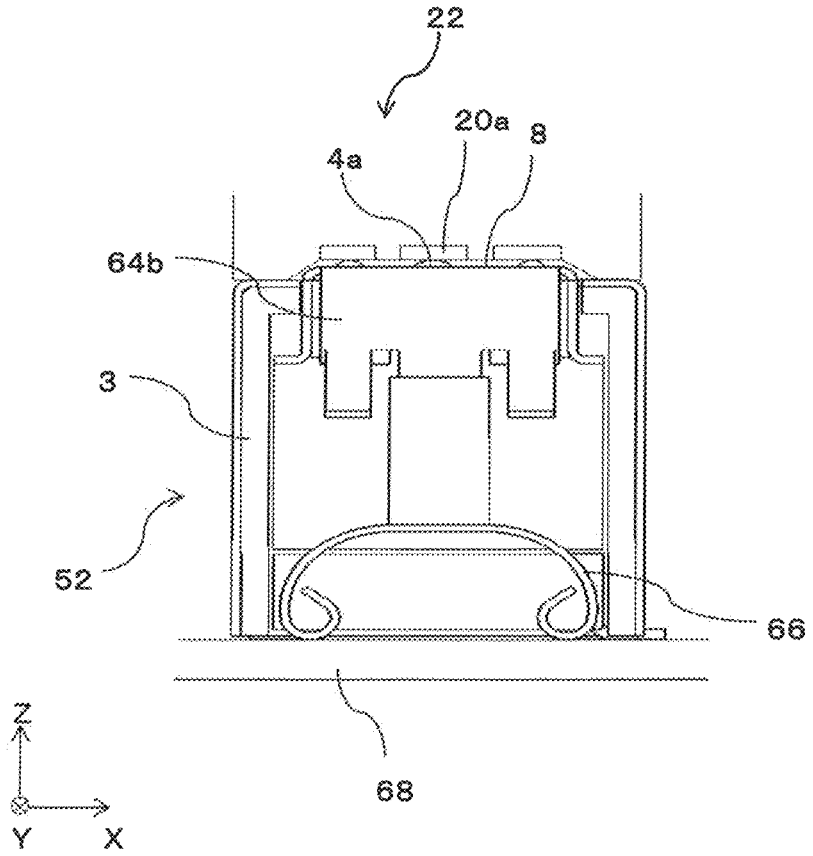
FIG. 14 is a cross-sectional view of the connector according to the second embodiment.

FIG. 14 is a view illustrating a state in which a personal digital assistant 22 is mounted to the connector 52 according to the second embodiment and illustrating a state in which the connector 52 is cut on an E-E cross-sectional surface illustrated in FIG. 10. First, the protection member 8 is located at a first position in the initial state (see FIG. 6). Herein, a lower end portion of the elastic body 66 may or may not come into contact with a substrate 68 in the initial state.

Next, in the connecting process, when a connecting terminal 20*a* of the personal digital assistant 22 is pressed against the contact point 4*a* of the connector 52 in the initial state, and a downward (−Z direction side) pressing force is applied to the contact point 4*a*, the contact point 4*a* moves downward, the contact 4 is compressed in a Z axis direction, and the protection member 8 covering the contact 4 moves downward. In the case where the elastic body 66 does not come into contact with the substrate 68 in the initial state, a lower end portion of the elastic body 66 comes into contact with a metal portion of the substrate 68 at this point.

When the contact point 4*a* further moves downward, as illustrated in FIG. 14, the protection member 8 of the connector 52 becomes in the final connection state at a position of a second position, and the contact point 4*a* is always biased upward by a spring force of the compressed contact 4, and the contact point 4*a* comes into contact with the connecting terminal 20*a* by a sufficient contact force. On the other hand, the elastic body 66 is compressed and bent in a Z axis direction by a downward press force (−Z direction side). Therefore, the elastic body 66 does not interrupt movement of the protection member 8 to the second position.

Figure 15:
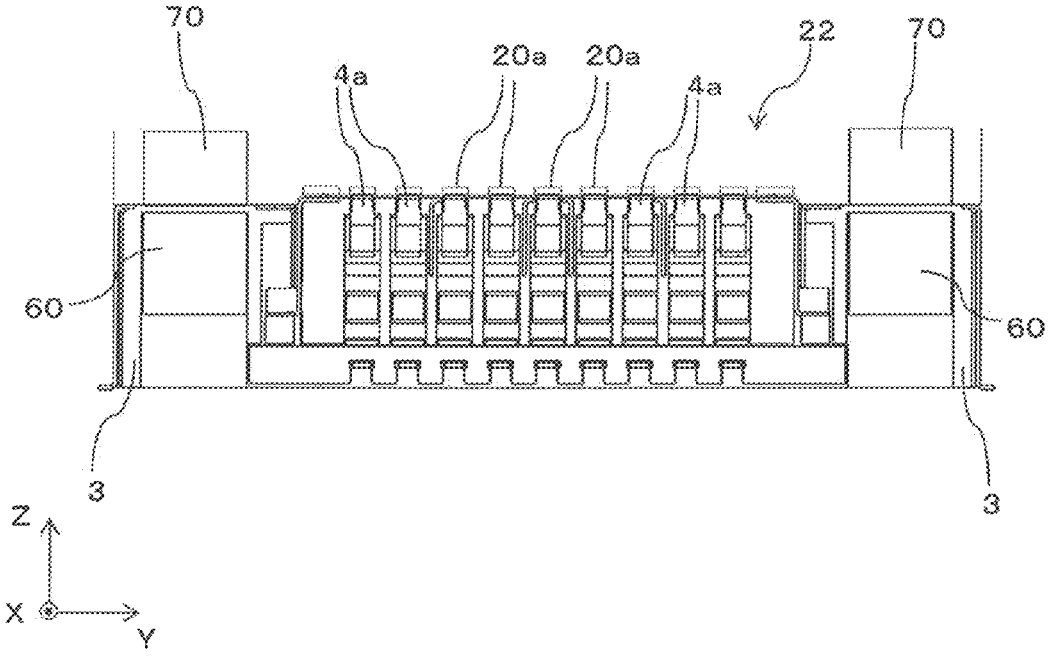
FIG. 15 is a cross-sectional view of the connector according to the second embodiment.

Herein, FIG. 15 is a view illustrating a YZ cross-sectional surface of the connector 52 in the final connection state and the personal digital assistant 22. As illustrated in FIG. 15, the personal digital assistant 22 includes a magnetic body 70 at both ends in a Y axis direction. Therefore, in the case where the personal digital assistant 22 is mounted to the connector 52, and the connector 52 is in the final connection state, the magnet 60 and the magnetic body 70 pull against each other by a magnetic force generated between the magnet 60 and the magnetic body 70, and the connection state between the connector 52 and the personal digital assistant 22 is maintained.

According to the connector 52 according to the second embodiment, a connection state between the connector 52 and the personal digital assistant 22 can be certainly maintained by using a magnetic force in the final connection state, and the contact point 4*a* of the contact 4 and the connecting terminal 20*a* are certainly connected. Also, when a lower end portion of the elastic body 66 comes into contact with a metal portion of the substrate 68, the shield member 64 and metal portions of the substrate 68 are electrically connected. Accordingly generation of noise to an electrical signal between the connector 52 and the personal digital assistant 22 is prevented.

Figure 16:
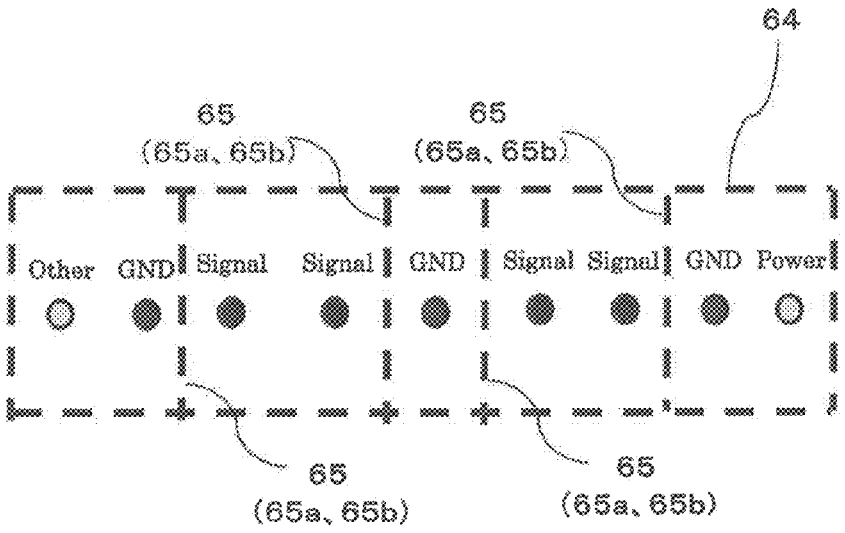
FIG. 16 is an image diagram of USB pin assignment according to the second embodiment.
Figure 17:
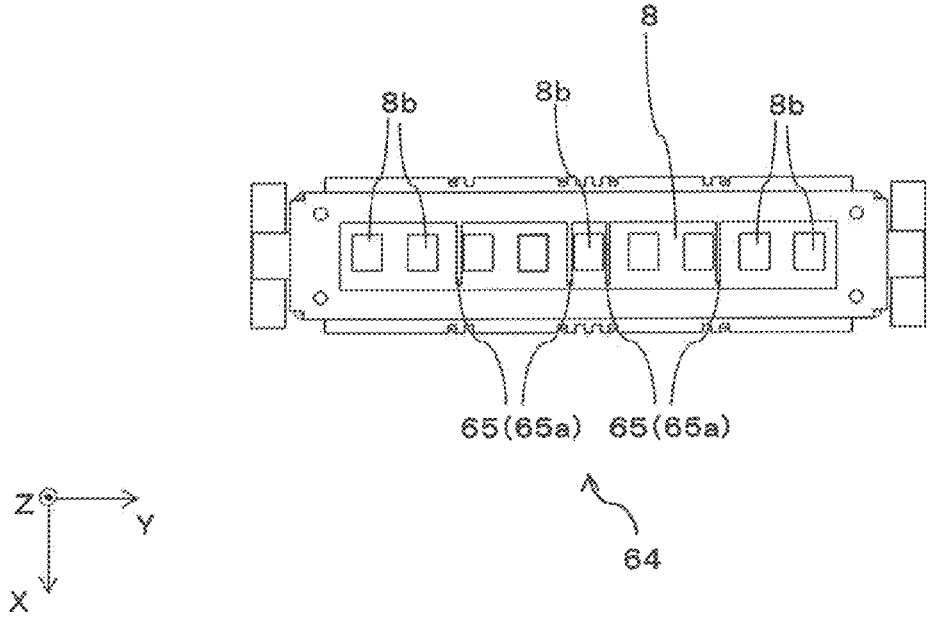
FIG. 17 is a top view of the shield member according to the second embodiment.

In the connector 52 according to the second embodiment, a differential pair having two signal lines may be included in USB pin assignment. FIG. 16 is an image illustrating USB 3.0 pin assignment, and illustrates a positional relation among the USB pin assignment, the shield member 64 (dotted line portions in FIG. 16), and the metal plate 65 (dotted line portions in FIG. 16). FIG. 17 is a top view of the shield member 64 in this case.

As illustrated in FIG. 16, the metal plate 65 is arranged at a position separating the differential pair having two signal lines Signal and other signal lines (such as GND, Other, and Power). By arranging the metal plate 65 at the position, crosstalk between an electrical signal of the differential pair and electrical signals of other signal lines is prevented in the case where the personal digital assistant 22 is mounted to the connector 52.

Figure 18:
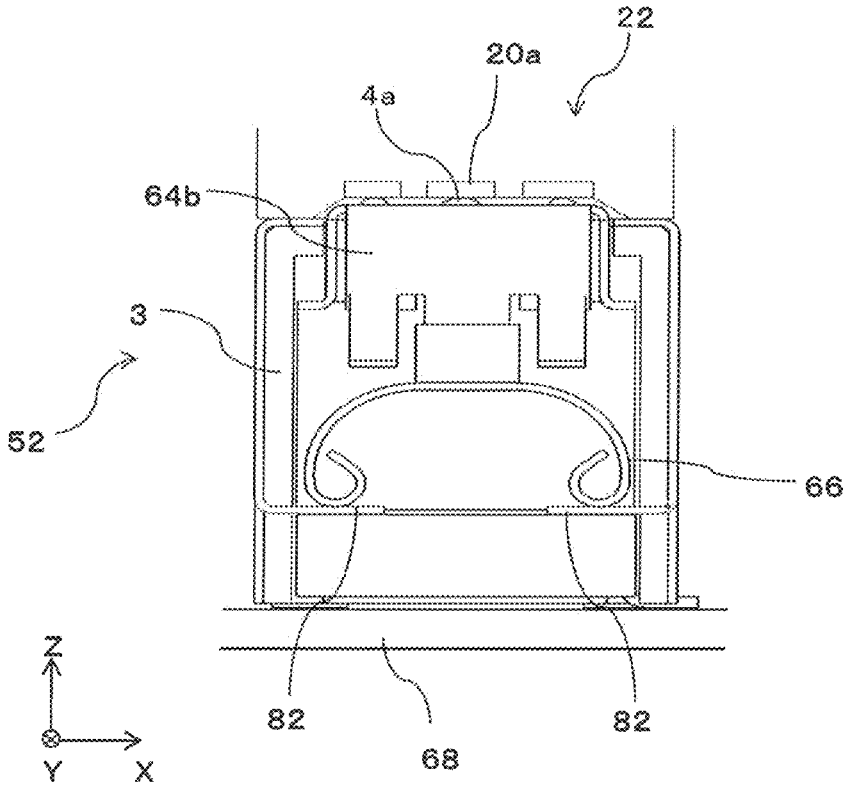
FIG. 18 is a cross-sectional view of the connector according to the embodiments.

In the above-described second embodiment, a member coming into contact with the elastic body 66 is not necessarily the substrate 68. For example, as illustrated in FIG. 18, a metal holding portion 82 extending in a direction parallel to an XY plane may be provided at both ends in a Y axis direction in the base body 3. The base body 3 includes a conductive member which is connected to the holding portion 82 and electrically connected to a metal portion of the substrate 68. In this case, when the protection member 8 moves downward, the elastic body 66 coming into contact with the holding portion 82 is compressed and bent in a Z axis direction by a downward pressing force. When the elastic body 66 comes into contact with the holding portion 82, the shield member 64 is electrically connected to a metal portion of the substrate 68 via the conductive member. As a result, it can prevent to mix noise in an electrical signal between the connector 52 and the personal digital assistant 22.

Figure 19:
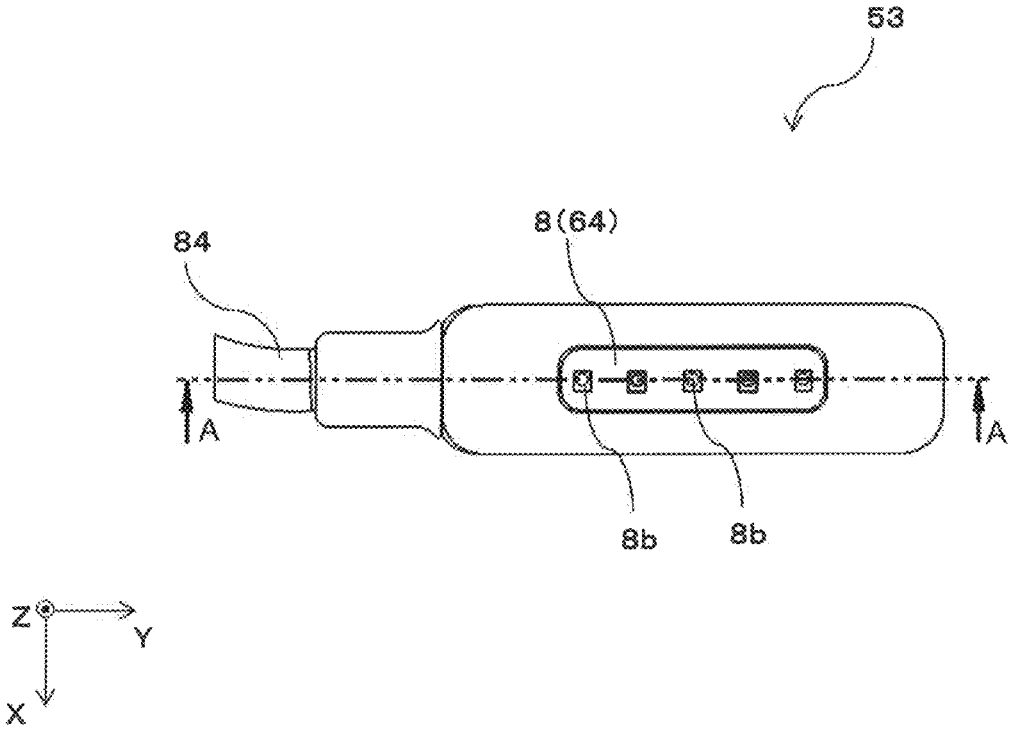
FIG. 19 is a view illustrating the connector according to the embodiments.
Figure 20:
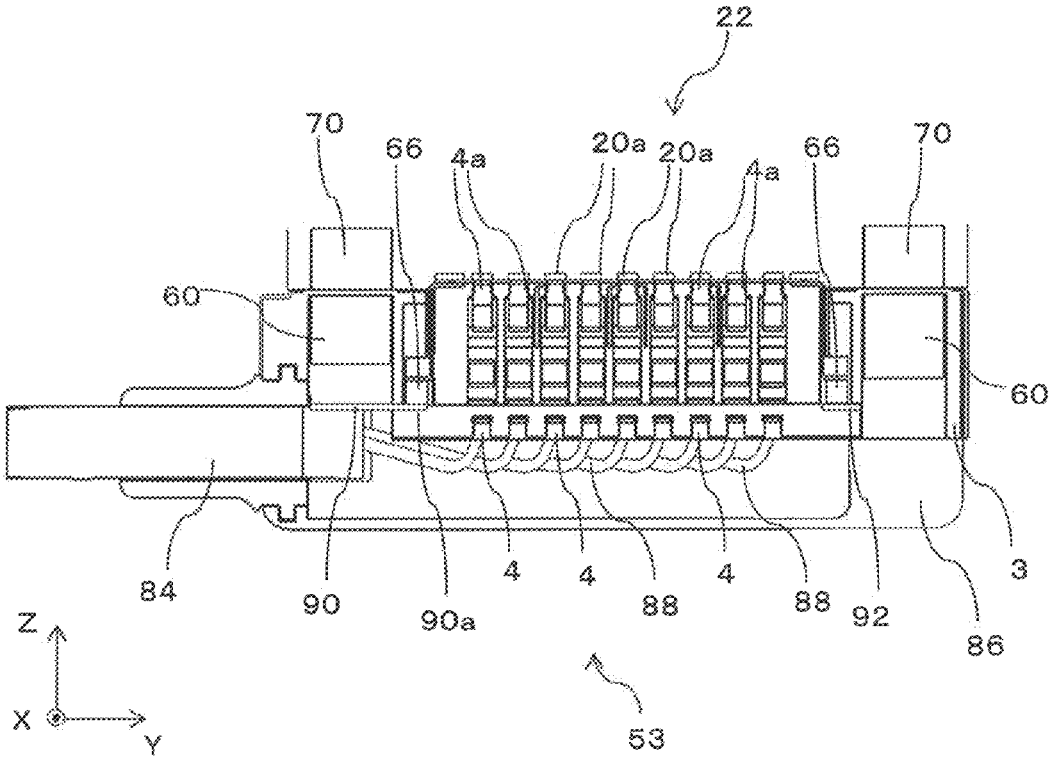
FIG. 20 is a cross-sectional view of the connector according to the embodiments.

In the above-described second embodiment, a cable connector 53 connected to a cable 84 may be used instead of the connector 52 as illustrated in FIG. 19. FIG. 20 is a view illustrating a state in which the personal digital assistant 22 is mounted to the cable connector 53 and illustrating a state in which the cable connector 53 is cut on an A-A cross-sectional surface illustrated in FIG. 19. As illustrated in FIG. 20, the contact 4 arranged in the base body 3 is connected to the cable 84 via a wire 88 covered by an undercover 86.

Herein, a tip portion 90*a* of a holding fitting 90 for holding the cable 84 extends directly below the elastic body 66 on a cable 84 side. Also, a metal fitting 92 is arranged directly below the elastic body 66 on a side opposite to the cable 84. In this case, when the protection member 8 moves downward, the elastic body 66 on the side of the cable 84 coming into contact with the tip portion 90*a* of the holding fitting 90 is compressed and bent in a Z axis direction. Also the elastic body 66 on the side opposite to the cable 84 coming into contact with the fitting 92 is compressed and bent in the Z axis direction. When the elastic body 66 comes into contact with the tip portion 90*a* of the holding fitting 90, the shield member 64 and the cable 84 are electrically connected. As a result, it prevents to mix noise in an electrical signal between the connector 52 and the personal digital assistant 22.

Also, in the above-described second embodiment, if a connecting state between the connector 52 and the personal digital assistant 22 can be maintained by a magnetic force, the connector 52 may not include the magnet 60, and the personal digital assistant 22 may not include the magnetic body 70. For example, the connector 52 may include the magnetic body 70, and the personal digital assistant 22 may include the magnet 60. Also, both of the connector 52 and the personal digital assistant 22 may include the magnet 60.

Figure 21:
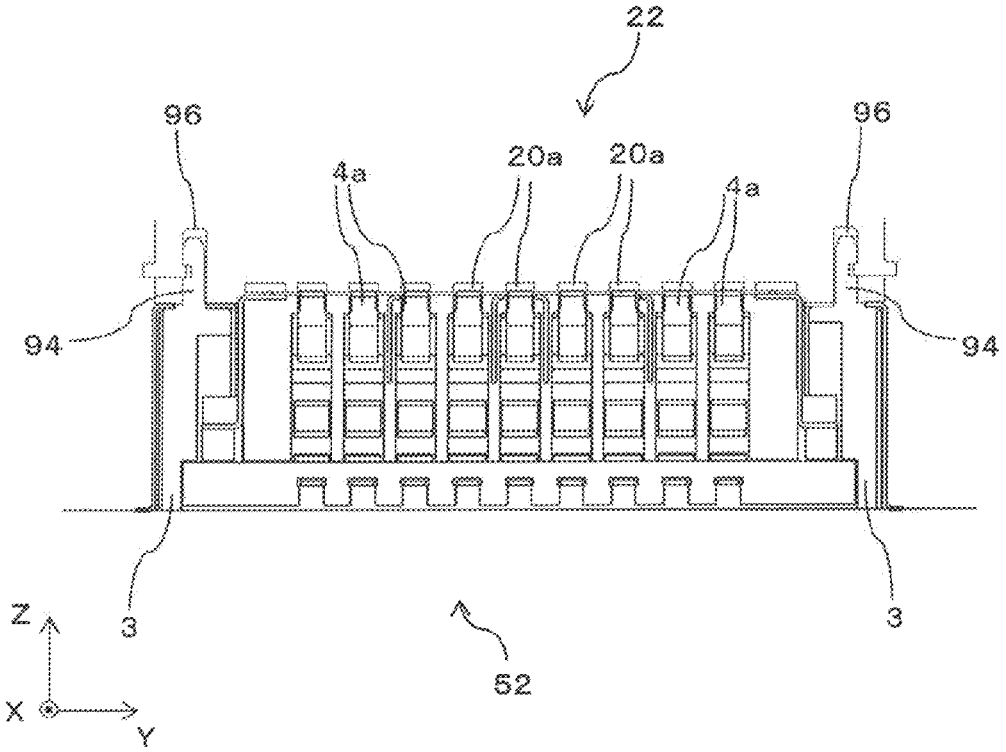
FIG. 21 is a cross-sectional view of the connector according to the embodiments.

In the above-described second embodiment, the connector 52 and the personal digital assistant 22 may be connected without using a magnetic force. For example, as illustrated in FIG. 21, a projecting portion 94 projecting on an upper side (+Z axis direction) is formed at both ends in a Y axis direction of the base body 3, and a fitting groove 96 fitting into the projecting portion 94 is formed to the personal digital assistant 22. In this case, when the connector 52 is mounted to the personal digital assistant 22, the projecting portion 94 is fitted into the fitting groove 96, and the connector 52 is locked by the personal digital assistant 22. Therefore, the connection state between the connector 52 and the personal digital assistant 22 are certainly maintained in the final connecting state.

Figure 22:
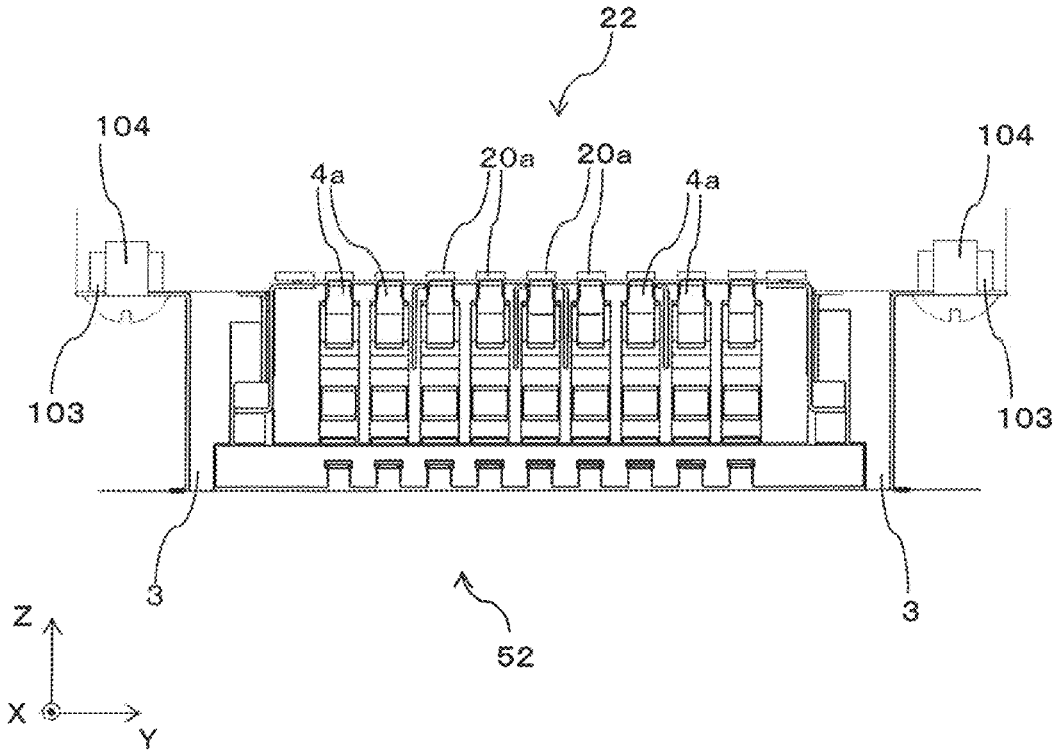
FIG. 22 is a cross-sectional view of the connector according to the embodiments.

Also, the connector 52 and the personal digital assistant 22 may have a screwing structure. For example, as illustrated in FIG. 22, a screw hole 103 may be formed to the connector 52 so that the connector 52 can be fixed to the personal digital assistant 22 by a screw 104 in the final connection state.

In the above-described each embodiment, the connector 2 and the connector 52 are mounted to an electronic device such as a cradle, a personal computer, a cell phone, a smartphone, and a tablet type information terminal.

The invention claimed is:

1. A connector comprising:

a contact including a contact point to be electrically connected to an external apparatus when a connecting terminal of the external apparatus is pressed against the contact point;

a protection member configured to protect the contact point by covering a periphery of the contact point of the contact; and a base body made of an insulator and storing the contact and the protection member, wherein the protection member includes an opening for projecting the contact point on the external apparatus side from a surface on which the external apparatus is pressed, and the protection member is movable between a first position and a second position with movement of the external apparatus;

before the external apparatus contacts with the contact point or the protection member, the contact point is arranged at a position so as to project on the external apparatus side from the opening and the protection member is positioned at the first position; and in a final connection state to the external apparatus, the contact point is arranged on the same plane as a surface on which the external apparatus of the protection member is pressed and the protection member is positioned at the second position.

2. A connector comprising:

a contact including a contact point to be electrically connected to an external apparatus when a connecting terminal formed on a pressing surface of the external apparatus is pressed against the contact point;

a protection member configured to protect the contact point by covering a periphery of the contact point of the contact; and a base body storing the contact and the protection member, wherein the protection member includes an opening for projecting the contact point on the external apparatus side from a surface of a pressed surface against which the pressing surface of the external apparatus is pressed, and the protection member is movable in a direction of pressing in which the pressing surface of the external apparatus is pressed and a direction opposite to the direction of pressing, the contact includes at least one press portion for pressing the protection member in the direction opposite to the direction of pressing, before the external apparatus contacts with the contact point or the protection member, the contact point is projected on the external apparatus side from the opening, and in a final connection state to the external apparatus, the press portion does not press the protection member in the direction opposite to the direction of pressing.

3. The connector according to claim 2, wherein the press portion is arranged on both sides of the contact point.

4. The connector according to claim 2, wherein the base body includes a locking portion for locking the protection member in the base body, and the protection member includes an engaging portion to be engaged with the locking portion when the protection member projects by a predetermined amount from the base body.

5. The connector according to claim 2, wherein the contact has an approximately S shape.

6. The connector according to claim 2, wherein the final connection state is maintained by any of a magnetic body, a locking structure, and a screwing structure, which is mounted to both of the external apparatus and the base body.

7. The connector according to claim 2, wherein the connector includes a shield member on a surface contacting with the external apparatus.

8. The connector according to claim 7, wherein the shield member included in the protection member covers a side wall surface extending in a longitudinal direction, a side wall surface extending in a lateral direction, and an opposing surface on the external apparatus side.

9. The connector according to claim 7, wherein the shield member attached to the protection member has an elastic body coming into contact with a metal portion of a substrate and bending.

10. The connector according to claim 7, wherein the shield member attached to the protection member has an elastic body coming into contact with a metal member included in the base body and bending.

11. The connector according to claim 7, wherein the shield member attached to the protection member has an elastic body coming into contact with a metal fitting contacting with a cable and bending.

12. The connector according to claim 7, wherein the shield member attached to the protection member is arranged between at least one differential pair and other signal lines.

13. The connector according to claim 12, wherein the differential pair is included in USB pin assignment.

14. The connector according to claim 7, wherein, when the multiple contacts are arranged, the shield member included in the protection member includes a metal plate interposed at least one place between the adjacent contacts.

15. The connector according to claim 14, wherein the metal plate interposed between the adjacent contacts is vertically bent from the opposing surface on the external apparatus side.

* * * * *